US009614299B2

(12) United States Patent
Ludwig et al.

(10) Patent No.: US 9,614,299 B2
(45) Date of Patent: Apr. 4, 2017

(54) DEVICE FOR ATTACHING AND CONTACTING AN ELECTRICAL COMPONENT AND METHOD FOR MANUFACTURING THE DEVICE

(71) Applicant: Robert Bosch GmbH, Stuttgart (DE)

(72) Inventors: Matthias Ludwig, Moessingen (DE); Juergen Kurle, Reutlingen (DE); Conrad Haeussermann, Trochtelfingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/940,829

(22) Filed: Nov. 13, 2015

(65) Prior Publication Data

US 2016/0141769 A1 May 19, 2016

(30) Foreign Application Priority Data

Nov. 17, 2014 (DE) ..... 10 2014 223 353

(51) Int. Cl.

| | |
|---|---|
| ***H01R 13/11*** | (2006.01) |
| ***H01R 4/28*** | (2006.01) |
| ***H01R 43/16*** | (2006.01) |
| ***H01R 4/48*** | (2006.01) |
| ***H01R 12/70*** | (2011.01) |
| *H01R 11/32* | (2006.01) |
| *H01R 12/72* | (2011.01) |

(52) U.S. Cl.

CPC ..... *H01R 4/28* (2013.01); *H01R 4/4809* (2013.01); *H01R 12/7076* (2013.01); *H01R 43/16* (2013.01); *H01R 11/32* (2013.01); *H01R 12/721* (2013.01)

(58) Field of Classification Search

CPC ..... H01R 11/32
USPC ..... 439/858, 907, 908
See application file for complete search history.

(56) References Cited

U.S. PATENT DOCUMENTS

| | | | | |
|---|---|---|---|---|
| 7,175,488 B2 * | 2/2007 | Pavlovic | ..... | H01R 13/113 439/620.27 |
| 2013/0012072 A1 * | 1/2013 | Costello | ..... | H01R 13/18 439/660 |

* cited by examiner

*Primary Examiner* — Tho D Ta
(74) *Attorney, Agent, or Firm* — Gerard Messina

(57) ABSTRACT

A device for attaching and contacting an electrical component, e.g., a sensor device, includes: at least two contact points which are electrically contactable via associated busbars, a contact point of the component being connected to the associated busbar via a respective connecting element, which at its respective free first end forms a mounting for the component and establishes the electrical connection to the contact point of the component in the mounting, and which at its respective second end is held on the busbar and is electrically connected thereto.

23 Claims, 4 Drawing Sheets

DEVICE FOR ATTACHING AND CONTACTING AN ELECTRICAL COMPONENT AND METHOD FOR MANUFACTURING THE DEVICE

BACKGROUND OF THE INVENTION

1. Field of the Invention

The present invention relates to a device and a method for attaching and contacting an electrical component, in particular a sensor device, having at least two contact surfaces which are electrically contactable via associated busbars.

2. Description of the Related Art

It is known to use a circuit board for sensors which is equipped with a sensor element and, for example, with capacitors. The capacitors are used to increase the safety against electrostatic discharge (ESD safety). This equipped circuit board represents the electrical component or the sensor device which is usually electromechanically contacted in a plastic sensor housing with the aid of pressfit technology. Subsequently, the plastic sensor housing is tightly sealed with a plastic cover with the aid laser transmission welding (LTW). Alternative joining methods still require the complex soldering as an electromechanical joint and additionally apply a high mechanical load onto the circuit board or the electrical component.

BRIEF SUMMARY OF THE INVENTION

The device and the method according to the present invention have the advantage over the related art that a simple device having little complexity for attaching and contacting the electrical component is provided, which requires fewer individual parts and fewer individual steps for manufacturing. In addition to a reduction of the manufacturing costs in mass manufacturing, it is furthermore also possible to achieve short tolerance chains. It is particularly advantageous that the use of smaller, thinner, and consequently also more sensitive components in the form of land grid arrays (LGAs) sheathed with the aid of injection molding processes is made possible. The method according to the present invention ensures that narrow position tolerances of the component in its mounting may even be adhered to at all times in mass manufacturing of the device.

Good positioning and attachment of the LGA result when the mounting at the first end of the connecting element has a clamp-shaped and/or fork-shaped and/or bracket-shaped design.

Reliable electrical contacting of the component with the connecting element results from a clamping contact within the mounting.

Reliable shielding is accomplished by surrounding the component with a metal cage open at the end face, which is formed by mountings of the at least two connecting elements.

Good positioning and attachment of the LGA results when the connecting element has a multi-piece design made up of multiple elements.

A reliable electrical connection and shielding of the LGA and reliable attachment result when the connecting element is made of spring steel.

A reliable electrical connection and attachment of the LGA result when the second end of the connecting element is connected to the busbar with the aid of clinching and/or with the aid of friction welding and/or with the aid of a clamping contact.

A reliable electrical connection of the LGA results when the busbars include elevations for contacting the contact points of the component.

DETAILED DESCRIPTION OF THE INVENTION

Figure 1:
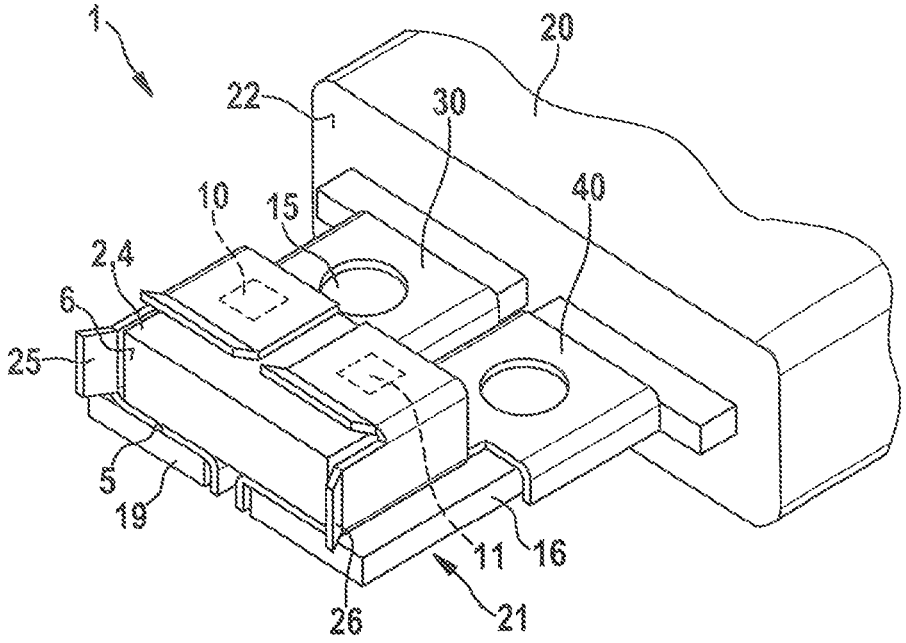
FIG. 1 shows in a perspective view a front view of a device according to the present invention for a two-pole component according to a first exemplary embodiment.

FIG. 1 shows in a perspective front view a device 1 for attaching and contacting an electrical component 2. Component 2 is a sensor device or an electronics module, as it is used in an acceleration sensor in the automobile sector, for example. The sensor device usually includes an acceleration chip, an application-specific integrated circuit (ASIC) chip, and passive components, which are all combined in a land grid array (LGA) sheathed with the aid of an injection molding process. The component or LGA 2 has a plate shape and, in the two-pole design, has at least two contact points 10, 11 on its top side 4 or on its bottom side 5, which are indicated by dotted lines and are electrically contactable via busbars 15, 16. Bottom side 5 of LGA 2 faces busbars 15, 16; top side 4 faces away from busbars 15, 16. In the exemplary embodiment, contact points 10, 11 are provided on top side 4. Busbars 15, 16 extending in parallel to each other are accommodated in an embedding 20, for example made of plastic, a free section 21 of busbars 15, 16 projecting from embedding 20 from an end face 22. Busbars 15, 16 are an integral part of a plug connection not shown in greater detail, for example of a plug which is used to contact component 2 or the acceleration sensor.

Figure 2:
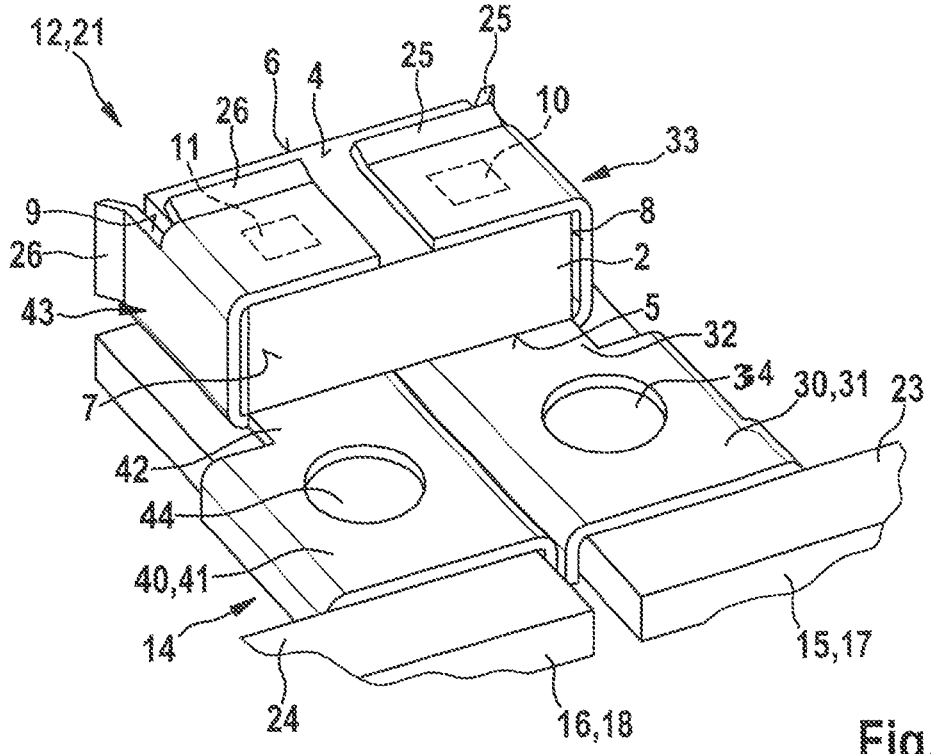
FIG. 2 shows in a perspective view a corresponding rear view of the first exemplary embodiment.
Figure 3:
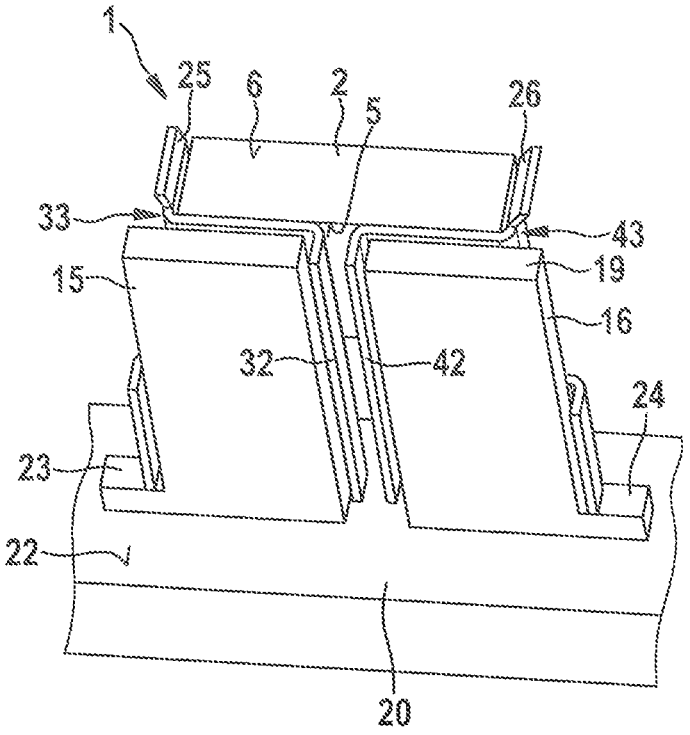
FIG. 3 shows in a perspective view a corresponding view from beneath of the first exemplary embodiment.

According to the present invention, it is now provided that the attachment and electrical contacting of LGA 2 is carried out with the aid of connecting elements, a first connecting element 30 and a second connecting element 40, which each connect one contact point 10, 11 of LGA 2 to associated busbar 15, 16. As is shown in greater detail in FIG. 2 in a perspective rear view of device 1, each connecting element 30; 40 has a multi-piece design for this purpose and includes a contacting section 31; 41, a connecting section 32; 42, and a holding section 33; 43. Contacting sections 31, 41 are oriented close to embedding 20 in the area of busbars 15, 16 and rest against provided widenings 23, 24 of busbars 15, 16, for example. Contacting sections 31; 41 have a U-shaped cross section in order to encompass top side 17, 18 of busbars 15, 16 in a rail-like or clamp-like manner. Contacting sections 31, 41 each transition into the planar connecting section 32, 42 which extends on top side 17, 18 of busbars 15, 16 and on which the bracket-like, clamp-like holding section 33, 43 is formed. Holding sections 33, 43 together form the mounting of LGA 2 at a free first end 12 of connecting elements 30, 40. Holding section 33 of first connecting element 30 extends upward from top side 17 of busbar 15 and encompasses a lateral surface 8 of LGA 2 in the manner of a clamp so that top side 4 and bottom side 5 of LGA 2 are partially accommodated in holding section 33. Correspondingly, the opposing lateral surface 9 is encompassed by holding section 43 of second connecting element 40. The two holding sections 33, 43 are positioned close to each other and completely cover lateral surfaces 8, 9 and substantially cover top side 4 and bottom side 5 of LGA 2. Overall, holding sections 33, 43 thus form a mounting for LGA 2, which remains open at its front side 6 and at its backside 7, overall essentially a metal cage being present which surrounds LGA 2. It is also conceivable to design holding sections 33, 43 in such a way that also backside 7 of LGA 2 is covered. As is shown in greater detail in a perspective view from beneath in FIG. 3, ends 19 of busbars 15, 16 terminate with front side 6 of LGA 2 and with holding sections 33, 43 of connecting elements 30, 40.

Corresponding insertion angles 25, 26 extend holding sections 33, 43 at the two lateral surfaces 8, 9 and on top side 4 of LGA 2 in order to simplify the insertion of LGA 2 in its mounting during assembly. Inserted LGA 2 is mounted by clamping, holding sections 33, 43 provided on top side 4 also performing the contacting of contact points 10, 11.

To avoid torque which could act on LGA 2, the clamping contacting is carried out in such a way that the supporting surfaces, here top sides 17, 18 of busbars 15, 16, are always positioned directly beneath the clamping contact point. This condition results in a metal cage having a multi-piece design. Connecting elements 30, 40 are preferably made of a resilient material, such as spring steel. LGA 2 has two contact points 10, 11 or has a two-pole design. A multi-pole design is also possible, as is shown in greater detail in FIGS. 4, 5, and 6. LGA 2 is composed as a system in package (SIP) and is electrically and mechanically contacted. This is also carried out in a multi-pole design. It is advantageous to enclose LGA 2 in holding sections configured as spring steel cage 33, 43, preferably completely, in order to shield the same preferably well against electromagnetic radiation. The electrical contacting is carried out without a fused joint, such as soldering, but solely by the clamping contact within holding sections 33, 43 at contact points 10, 11. The second end 14 of the spring steel cage or of connecting elements 30, 40 is, in turn, electromechanically connected to associated busbars 15, 16. Busbars 15, 16 are made of bronze, for example. Busbars 15, 16 are an integral part of a plug for contacting LGA 2.

The joint between connecting elements 30, 40 made of spring steel and busbars 15, 16 made of bronze is a bond of dissimilar metals and is valued for its mechanical, electrical and chemical or corrosive properties. The electrical and chemical properties are primarily defined via the surfaces of the metal sheets which are used. These may be influenced via coatings or a layering system, as is known from plug connections. The mechanical stability must be designed in such a way that a durable joint is created which withstands the further processing and the loads in the application with sufficient reliability.

The joint between spring steel elements 30, 40 and busbars 15, 16, which are usually made of a bronze alloy, is preferably carried out by clinching at contacting sections 31, 41. The contacting sections may have a circular opening 33, 34 toward busbars 15, 16, for example. As an alternative, it is also possible to use friction welding or a clamping contact. Due to the increasing miniaturization of electronics components, the joint between dissimilar metals must be carried out in the smallest of spaces, which is why traditional connecting methods such as crimping or screwing are not an option.

Figure 4:
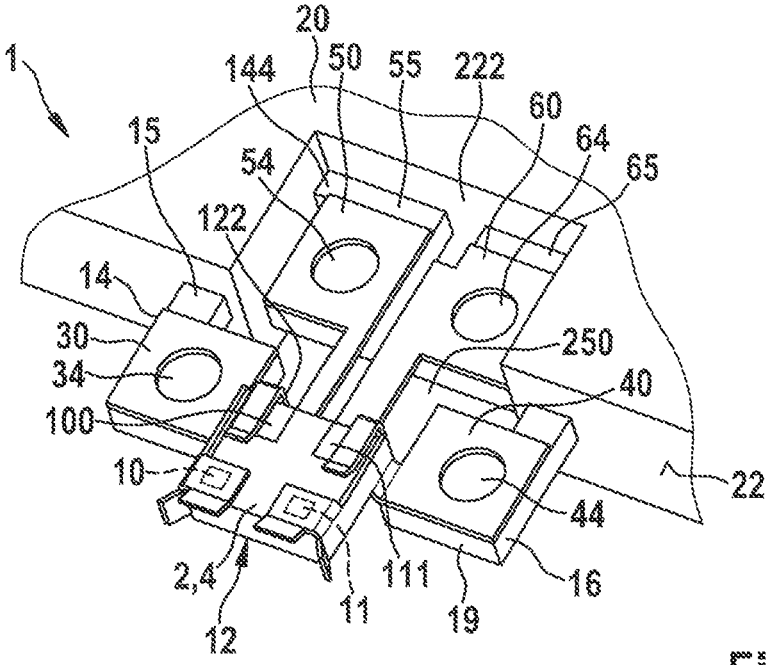
FIG. 4 shows in a perspective view a front view of the device according to the present invention for a four-pole component according to a second exemplary embodiment.
Figure 5:
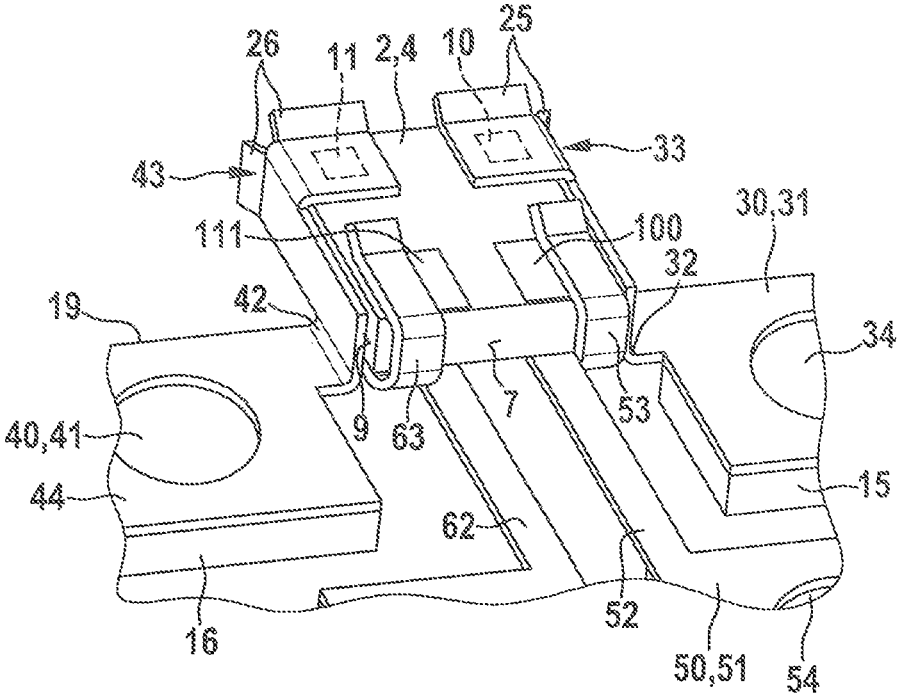
FIG. 5 shows in a perspective view a corresponding rear view of the second exemplary embodiment.
Figure 6:
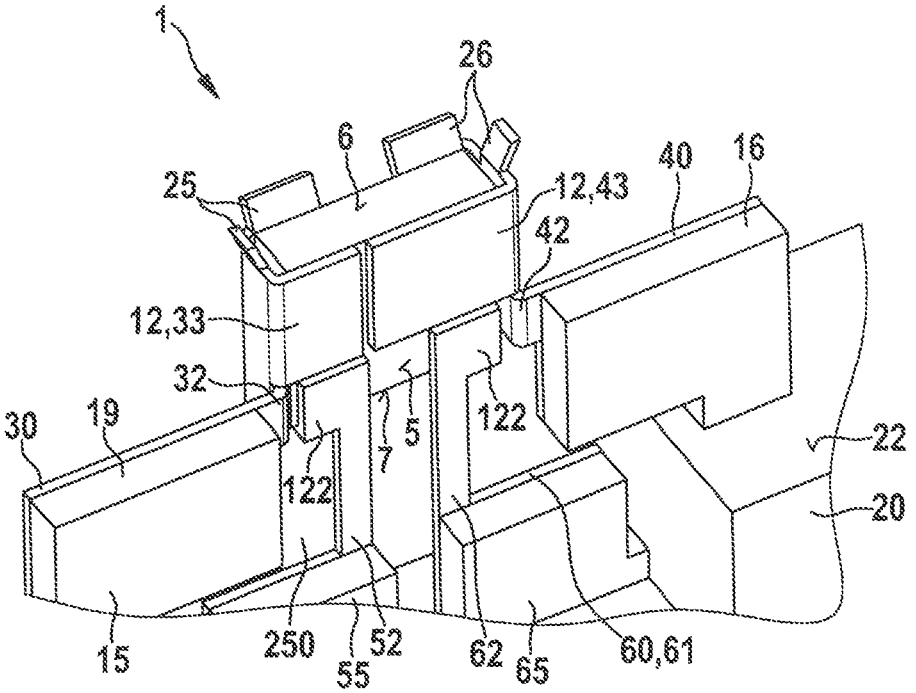
FIG. 6 shows in a perspective view a corresponding view from beneath of the second exemplary embodiment.

FIGS. 4 through 6 show a second exemplary embodiment in which all identical or like-acting components are denoted by the same reference numerals as the first exemplary embodiment. LGA 2 shown in a perspective top view in FIG. 4 has a four-pole design and has four contact surfaces 10, 11, 100, 111, which are provided in the area of the corners of LGA 2, for example, and which are each contacted by a connecting element 30, 40, 50, 60. Consequently four busbars 15, 16, 55, 65 are also present, two being provided in pairs on the outside, hereafter referred to as the first busbar 15 and the second busbar 16, and two being provided in pairs on the inside. The inside busbars 55, 65 are hereafter referred to as the third busbar 55 and the fourth busbar 65. The third busbar 55 and the fourth busbar 65 are located within a rectangular recess 222 of end face 22 in embedding 20 for busbars 55, 65. Outside of recess 222, the first and second busbars 15, 16 project from the planar end face 22 of embedding 20. In this way, a lateral offset of the free ends 19 of paired busbars 15, 16 and 55, 65 exists, whereby a clearance 250 is present in between, which is used to accommodate LGA 2 within the mounting formed together by four connecting elements 30, 40, 50, 60 at their free first end 12, 122. As is shown in greater detail in FIG. 6 in a perspective view from beneath, front side 6 of LGA 2 protrudes beyond ends 19 of conductor rails 15, 16, and its backside 7 terminates approximately with ends 19.

The composition of the four connecting elements essentially corresponds to that in the first exemplary embodiment. The first and second connecting elements 30, 40 connect the first and second busbars 15, 16 via their contacting sections 31, 41 with contact points 10, 11 on LGA 2. Deviating from the first exemplary embodiment, contact points 10, 11 on top side 4 are provided closer to front side 6. Moreover, connecting sections 32, 42 adjoining contact sections 31, 41 do not extend rectilinearly, but are angled, and cover the lateral surfaces 8, 9, and it is not until the area of front side 6 or of contact points 15, 16 that they transition into holding sections 33, 43, which therefore cover only a front portion on top side 4 of LGA 2. Within holding sections 33, 43, contact points 10, 11 are encompassed, which are designed in a clamp-like or bracket-like manner, as in the first exemplary embodiment. As is shown in greater detail in FIG. 6, holding sections 33, 43 are designed to be wider on bottom side 5, where they cover approximately ⅔ of bottom side 5. Moreover, the second holding section 43 of the second connecting element 40 is designed to be wider on bottom side 5 than the first holding section 33 of the first connecting element 30. As in the first exemplary embodiment, insertion angles 25, 26 are provided at holding sections 33, 43 for improving assembly when inserting LGA 2 into the mountings.

A third connecting element 50 and a fourth connecting element 60 connect the third busbar 55 and the fourth busbar 65 via their contacting sections 51, 61 with contact points 100, 111 on LGA 2. Contact points 100, 111 are provided on top side 4 closer to backside 7. Connecting sections 52, 62 extend rectilinearly and include their holding sections 53, 63 at their free end 122. Holding sections 53, 63 are angled and essentially cramp-shaped or fork-shaped. Holding sections 53, 63 may then serve as a stop for LGA 2 during insertion of LGA 2 into holding sections 33, 43. As in the first exemplary embodiment, all contacting sections 31, 41, 51, 61 have openings 34, 44, 54, 64 and are electrically and mechanically fixedly connected to busbars 15, 16, 55, 65 with the aid of clinching, for example.

To ensure the position tolerance important for acceleration sensors, it is advantageous for manufacturing the device to initially connect the second ends 14, 144 of connecting elements 30, 40, 50, 60 to busbars 15, 16, 55, 65, and to then insert component 2 into the shared mounting formed by the at least two connecting elements 30, 40; 50, 60. This requires one open side in the spring steel cage, via which LGA 2 may subsequently be inserted.

Figure 7:
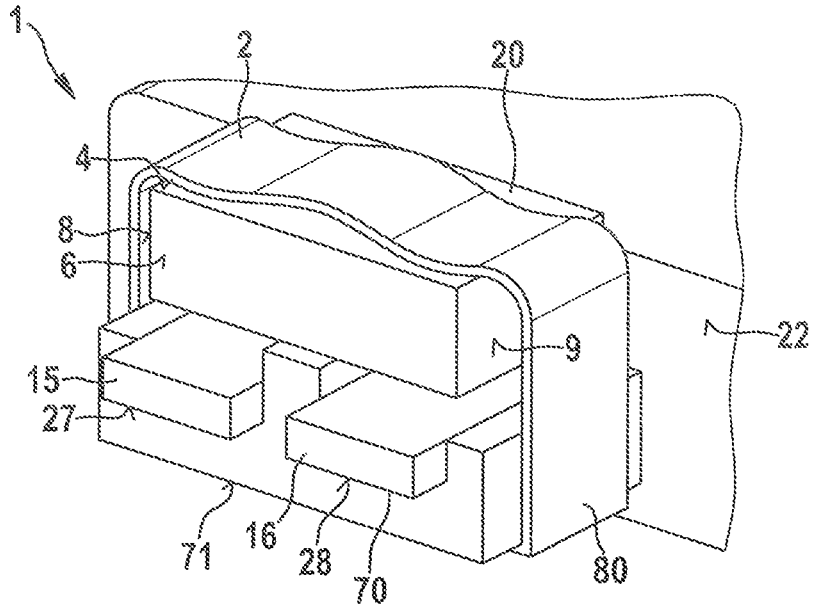
FIG. 7 shows in a perspective view a front view of the device according to the present invention for a two-pole component according to a third exemplary embodiment.
Figure 8:
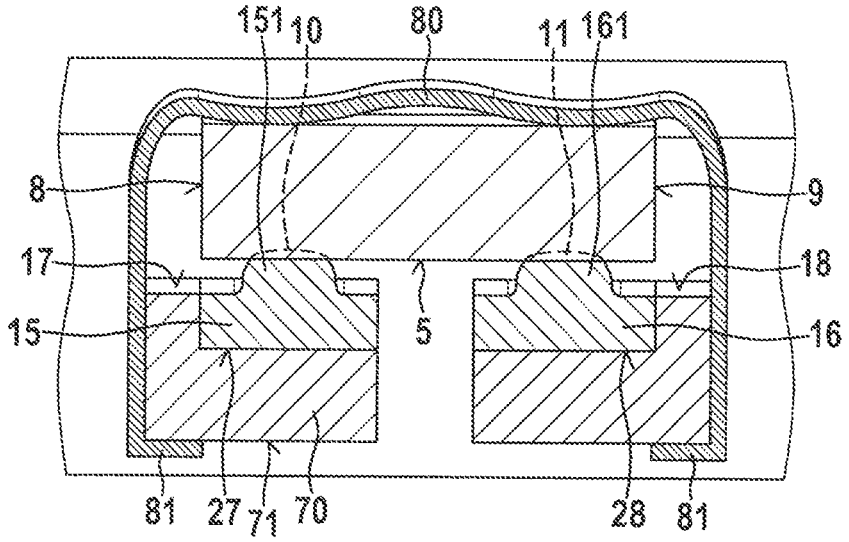
FIG. 8 shows a corresponding top view onto the third exemplary embodiment.

FIGS. 7 through 8 show a third exemplary embodiment in which identical or like-acting components are denoted by the same reference numerals as the preceding two exemplary embodiments. As is shown in a perspective view of device 1 in FIG. 7, busbars 15, 16 are modified compared to the two preceding exemplary embodiments by not being designed to be freely projecting, but accommodated in a protrusion or an overhang 70 spaced apart from end face 22 of embedding 20 for busbars 15, 16, bottom sides 27, 28 of busbars 15, 16 being supported on overhang 70. LGA 2 has a two-pole design, so that two busbars 15, 16 are present, which are accommodated in overhang 70 in embedding 20. As is shown in greater detail in FIG. 8 in a top view, contacting of LGA 2 on its bottom side 5 with contact points 10, 11 is carried out at the free top sides 17, 18 on provided elevations 151, 161 of busbars 15, 16. Elevations 151, 161 of busbars 15, 16 are designed in the form of hemispherical bulges, for example. Contact points 10, 11 of LGA 2 are pressed against bulges 151, 161 with the aid of a clamp 80, so that an electrical connection of LGA 2 with busbars 15, 16 is created by a clamping contact. Clamp 80 essentially encompasses top side 4 of LGA 2 and extends along top side 4 across lateral surfaces 8, 9 at a distance from the same and, with hook elements 81 on the bottom side, engages a bottom side 71 of overhang 70 for support. Clamp 80 forms a metal cage open at the end face. As in the preceding exemplary embodiments, clamp 80 is preferably made of spring steel and, contrary to the electrical and mechanical contacting of the preceding exemplary embodiments, assumes only the mechanical contacting of LGA 2 here.

The device according to the present invention is provided for sensors, in particular for acceleration sensors in the automobile sector.

What is claimed is:

1. A device for attaching and contacting an electrical component having at least two contact surfaces which are electrically contactable via associated busbars, the device comprising:

at least one connecting element connecting a contact point of the electrical component to an associated busbar, wherein the at least one connecting element has (i) a first end which forms a mounting for the electrical component and establishes an electrical connection to the contact point of the electrical component in the mounting, the mounting including a portion located between the electrical component and the busbar, and (ii) a second end which is held on the busbar and is electrically connected to the busbar.

2. The device as recited in claim 1, wherein the mounting at the free first end of the connecting element has at least one of a clamp-like, fork-like, and bracket-like configuration.

3. The device as recited in claim 1, wherein the electrical connection between the electrical component and the connecting element is established by a clamping contact within the mounting.

4. A device for attaching and contacting an electrical component having at least two contact surfaces which are electrically contactable via associated busbars, the device comprising:

at least two connecting elements, each connecting a contact point of the electrical component to an associated busbar and having (i) a first end which forms a mounting for the electrical component and establishes an electrical connection to the contact point of the electrical component in the mounting, and (ii) a second end which is held on the busbar and is electrically connected to the busbar, wherein the mountings of the at least two connecting elements form a metal cage open at an end face and at least partially surrounding the electrical component.

5. The device as recited in claim 1, wherein the at least one connecting element has a multi-piece design made up of multiple elements.

6. The device as recited in claim 1, wherein the at least one connecting element is made of spring steel.

7. The device as recited in claim 1, wherein the second end of the at least one connecting element is connected to the associated busbar with the aid of at least one of clinching, friction welding, and a clamping contact.

8. A device for attaching and contacting an electrical component having at least two contact points which are electrically contactable via associated busbars, the device comprising:

at least one connecting element configured as a clamp and at least partially surrounding the component in a clamp-like manner, the at least one connecting element being supported on an embedding for the busbars and pressing the contact points of the electrical component against the busbars for the electrical connection.

9. The device as recited in claim 8, wherein the connecting element is made of spring steel.

10. The device as recited in claim 8, wherein the busbars include elevations for contacting the contact points of the component.

11. A method for attaching and contacting an electrical component having at least two contact surfaces which are electrically contactable via associated busbars, using a device including at least two connecting elements each connecting a contact point of the electrical component to an associated busbar, wherein each one of the at least two connecting elements has (i) a first end which forms a shared mounting for the electrical component and establishes an electrical connection to the contact point of the electrical component in the mounting, and (ii) a second end which is held on the busbar and is electrically connected to the busbar, the method comprising:

initially connecting the second ends of the at least two connecting elements to the busbars; and subsequently inserting the electrical component into the shared mounting formed by the at least two connecting elements so that a portion of the mounting is located between the electrical component and the busbars.

12. The method as recited in claim 11, wherein the second ends of the at least two connecting elements are connected to the busbar with the aid of at least one of clinching, friction welding, and a clamping contact.

13. The method as recited in claim 11, wherein the mounting portion between the electrical component and the busbars physically separates the electrical component from the busbars.

14. The method as recited in claim 11, wherein the free end establishes the electrical connection to the contact point on a surface of the electrical component substantially facing away from the busbars.

15. The device as recited in claim 1, wherein the mounting portion between the electrical component and the busbar physically separates the electrical component from the busbar.

16. The device as recited in claim 1, wherein the free end establishes the electrical connection to the contact point on a surface of the electrical component substantially facing away from the busbar.

17. The device as recited in claim 1, wherein the free end further includes an insertion portion angled to, and extending away from, the mounting.

18. The device as recited in claim 4, wherein the at least two connecting elements include four connecting elements.

19. The device as recited in claim 4, wherein the electrical connections between the electrical component and the connecting elements are established by a clamping contact within the mountings.

20. The device as recited in claim 4, wherein the connecting elements are made of spring steel.

21. The device as recited in claim 4, wherein the second ends of the connecting elements are connected to the associated busbars with the aid of at least one of clinching, friction welding, and a clamping contact.

22. The device as recited in claim 4, wherein the first ends establish the electrical connection to the contact points on a surface of the electrical component substantially facing away from the busbar.

23. A method for attaching and contacting an electrical component having at least two contact points which are electrically contactable to associated busbars, the method comprising:

at least partially surrounding the component in a clamp-like manner using at least one connecting element being supported on an embedding for the busbars; and pressing the contact points of the electrical component against the busbars for the electrical connection.

* * * * *